US011975903B2

(12) United States Patent
Markovic

(10) Patent No.: US 11,975,903 B2
(45) Date of Patent: May 7, 2024

(54) BLANK, CONTAINER HOLDER, AND PACKAGE FOR A FLEXIBLE WIPES CONTAINER

(71) Applicant: NICE-PAK PRODUCTS, INC., Orangeburg, NY (US)

(72) Inventor: Nevenka Markovic, Nutley, NJ (US)

(73) Assignee: NICE-PAK PRODUCTS, INC., Orangeburg, NY (US)

( * ) Notice: Subject to any disclaimer, the term of this patent is extended or adjusted under 35 U.S.C. 154(b) by 367 days.

(21) Appl. No.: 17/434,482

(22) PCT Filed: Feb. 6, 2020

(86) PCT No.: PCT/US2020/016945
§ 371 (c)(1),
(2) Date: Aug. 27, 2021

(87) PCT Pub. No.: WO2020/180448
PCT Pub. Date: Sep. 10, 2020

(65) Prior Publication Data

US 2022/0135304 A1 May 5, 2022

Related U.S. Application Data

(60) Provisional application No. 62/814,256, filed on Mar. 5, 2019.

(51) Int. Cl.
*B65D 75/52* (2006.01)
*B65D 75/58* (2006.01)
*B65D 83/08* (2006.01)

(52) U.S. Cl.
CPC ..... *B65D 75/525* (2013.01); *B65D 75/5877* (2013.01); *B65D 83/0805* (2013.01); *B65D 2575/586* (2013.01)

(58) Field of Classification Search
CPC ..... B65D 75/525; B65D 75/5877; B65D 83/0805; B65D 2575/586
(Continued)

(56) References Cited

U.S. PATENT DOCUMENTS 2,106,276 A * 1/1938 Heineman ..... B65D 71/30 53/48.8
2,564,997 A * 8/1951 Rome ..... B60R 7/084 224/543
(Continued)

FOREIGN PATENT DOCUMENTS

WO WO 2000/012394 A1 3/2000
WO WO 2015/111011 A2 7/2015

OTHER PUBLICATIONS

International Search Report dated May 7, 2020 in International Application No. PCT/US2020/016945.

*Primary Examiner* — Chun Hoi Cheung
*Assistant Examiner* — Brijesh V. Patel
(74) *Attorney, Agent, or Firm* — Baker Botts L.L.P.

(57) ABSTRACT

A blank, container holder, and wipes container package is disclosed. The wipes container holder has a base to support a side of a flexible wipes container, the base having a first side and a second side, a front panel extending from the first side of the base, wherein the front panel defines a slot to receive a lid of a flexible wipes container, and a back panel extending from the second side of the base. The flexible wipes container having a side and a top surface with a lid, wherein the base of the wipes container holder supports the side of the flexible wipes container and the lid of the flexible wipes container is received within the slot of the front panel, wherein the front and back panel of the wipes container holder cooperate together to couple the wipes container holder to the flexible wipes container.

20 Claims, 14 Drawing Sheets

(58) Field of Classification Search
USPC ..... 206/312, 812, 494, 471, 813, 233, 449; 211/73, 50; 383/66; 53/397, 410–411, 53/461; 221/45, 73; 229/103.2, 403
See application file for complete search history.

(56) References Cited

U.S. PATENT DOCUMENTS 2,713,966 A * 7/1955 Moulin ..... B65D 71/00 229/87.01
2,786,572 A * 3/1957 Gentry ..... B65D 71/32 53/48.9
2,826,230 A * 3/1958 Conell ..... B65D 83/0805 206/37
3,281,051 A * 10/1966 O'Brien ..... B65D 77/0433 426/123
3,443,681 A * 5/1969 Wysocki ..... B65D 71/20 206/508
3,902,932 A * 9/1975 Gdanski ..... A47K 10/185 248/905
4,138,034 A * 2/1979 McCarthy ..... A47K 10/421 221/48
4,221,320 A * 9/1980 Faller ..... B65D 5/38 229/125.05
4,735,317 A * 4/1988 Sussman ..... A47K 10/185 206/815
4,790,436 A * 12/1988 Nakamura ..... B65D 83/0805 229/125.17
5,123,527 A * 6/1992 Hustad ..... B65D 1/36 206/769
5,145,091 A * 9/1992 Meyers ..... B65D 75/5838 221/45
5,823,333 A * 10/1998 Mori ..... G11B 33/0494 206/312
5,996,797 A * 12/1999 Flaig ..... B65D 77/02 229/230
6,032,795 A * 3/2000 Ehrlund ..... B65D 5/38 206/312
6,059,182 A * 5/2000 Wein ..... B65D 5/742 229/219
6,386,360 B1 * 5/2002 Williams ..... G11B 33/0494 206/312
6,948,625 B2 * 9/2005 Keberlein ..... B65D 83/0847 211/73
6,997,372 B2 * 2/2006 Gasparowicz ..... B65D 71/18 206/427
7,013,616 B1 * 3/2006 Powers ..... B65D 71/46 53/399
7,281,630 B2 * 10/2007 Hartman ..... B65D 77/0433 206/467
7,416,083 B2 * 8/2008 Bando ..... A47K 10/421 206/812
7,665,629 B2 2/2010 Julius et al.
8,607,986 B2 * 12/2013 Lipinski ..... B65D 75/02 206/764
8,939,320 B2 1/2015 Schiering et al.
9,230,388 B2 1/2016 Julius et al.
9,826,736 B2 11/2017 Napolitano et al.
2004/0035738 A1 2/2004 Julius
2005/0194395 A1 9/2005 Julius
2011/0266280 A1 * 11/2011 Thomas ..... B65D 75/525 53/461
2011/0297693 A1 * 12/2011 Crabill ..... B65D 5/3614 221/45
2014/0016882 A1 * 1/2014 Fitzwater ..... B65D 75/525 383/111
2015/0210466 A1 * 7/2015 Stephens ..... B65D 77/02 206/233
2015/0210467 A1 * 7/2015 Stephens ..... B65D 83/0805 206/233
2015/0217897 A1 8/2015 Fitzwater
2017/0202409 A1 7/2017 Cahalan et al.

* cited by examiner

BLANK, CONTAINER HOLDER, AND PACKAGE FOR A FLEXIBLE WIPES CONTAINER

CROSS-REFERENCE TO RELATED APPLICATIONS

The present application is a U.S. National Stage Patent Application under 35 U.S.C. § 371 of International Application No. PCT/US2020/016945, filed on Feb. 6, 2020, which is related to, and claims the benefit of, U.S. Provisional Application Ser. No. 62/814,256, filed Mar. 5, 2019, the contents of each of which are herein incorporated by reference in their entirety.

BACKGROUND OF THE DISCLOSED SUBJECT MATTER

Field of the Disclosed Subject Matter

The disclosed subject matter relates to a blank, container holder made from the blank, and package for a flexible wipes container. Particularly, the presently disclosed subject matter is directed to a blank, container holder made from the blank, and package that can position a flexible wipes container on its transverse side during use, amongst other things.

Description of the Related Art

A variety of container holder systems require significant amounts of material, are not cost effective, and create waste. Further, such systems have limitations in holding containers during use and operation of the container, such as package boots as commonly used in the packaging industry. For example, International PCT Publication WO 2000/12394 is directed to an "Improved Packaging" that describes a tubular construction that completely surrounds a flow wrap package such that the construction must be manipulated in order to open the flow wrap package within the construction.

There thus remains a continued need for an efficient and economic system for a blank, container, and package for a flexible wipes container. The presently disclosed subject matter satisfies these and other needs.

SUMMARY OF THE DISCLOSED SUBJECT MATTER

The purpose and advantages of the disclosed subject matter will be set forth in and are apparent from the description that follows, as well as will be learned by practice of the disclosed subject matter. Additional advantages of the disclosed subject matter will be realized and attained by the devices particularly pointed out in the written description and claims hereof, as well as from the appended drawings.

To achieve these and other advantages and in accordance with the purpose of the disclosed subject matter, as embodied and broadly described, the disclosed subject matter includes a unitary blank for forming a wipes container holder comprising: a base defined by fold lines of the blank to support a side of a flexible wipes container, the fold lines defining a first side of the base and a second side of the base; a front panel extending from the first side of the base, wherein the front panel defines a slot to receive a lid of a flexible wipes container; and a back panel extending from the second side of the base, wherein the unitary blank forms the wipes container holder and the front and back panel cooperate together to form a wipes container holder to couple with a flexible wipes container.

In accordance with another aspect of the disclosed subject matter, a wipes container holder is provided comprising: a base to support a side of a flexible wipes container, the base having a first side and a second side; a front panel extending from the first side of the base, wherein the front panel defines a slot to receive a lid of a flexible wipes container; and a back panel extending from the second side of the base, wherein the front and back panel cooperate together to couple the wipes container holder to a flexible wipes container.

In accordance with another aspect of the disclosed subject matter, a wipes container package is provided, comprising: a wipes container holder having a base to support a side of a flexible wipes container, the base having a first side and a second side, a front panel extending from the first side of the base, wherein the front panel defines a slot to receive a lid of a flexible wipes container, and a back panel extending from the second side of the base; and a flexible wipes container having a side and a top surface with a lid, wherein the base of the wipes container holder supports the side of the flexible wipes container and the lid of the flexible wipes container is received within the slot of the front panel, wherein the front and back panel of the wipes container holder cooperate together to couple the wipes container holder to the flexible wipes container.

It is to be understood that both the foregoing general description and the following detailed description and drawings are examples and are provided for purpose of illustration and not intended to limit the scope of the disclosed subject matter in any manner.

The accompanying drawings, which are incorporated in and constitute part of this specification, are included to illustrate and provide a further understanding of the blank, holder, and package devices of the disclosed subject matter. Together with the description, the drawings serve to explain the principles of the disclosed subject matter.

BRIEF DESCRIPTION OF THE DRAWINGS

The subject matter of the application will be more readily understood from the following detailed description when read in conjunction with the accompanying drawings, in which.

DETAILED DESCRIPTION

Reference will now be made in detail to embodiments of the disclosed subject matter, an example of which is illustrated in the accompanying drawings. The disclosed subject matter will be described in conjunction with the detailed description of the system.

In accordance with another aspect of the disclosed subject matter, a wipes container package is provided, comprising: a wipes container holder having a base to support a side of a flexible wipes container, the base having a first side and a second side, a front panel extending from the first side of the base, wherein the front panel defines a slot to receive a lid of a flexible wipes container, and a back panel extending from the second side of the base; and a flexible wipes container having a side and a top surface with a lid, wherein the base of the wipes container holder supports the side of the flexible wipes container and the lid of the flexible wipes container is received within the slot of the front panel, wherein the front and back panel of the wipes container holder cooperate together to couple the wipes container holder to the flexible wipes container.

Figure 1:
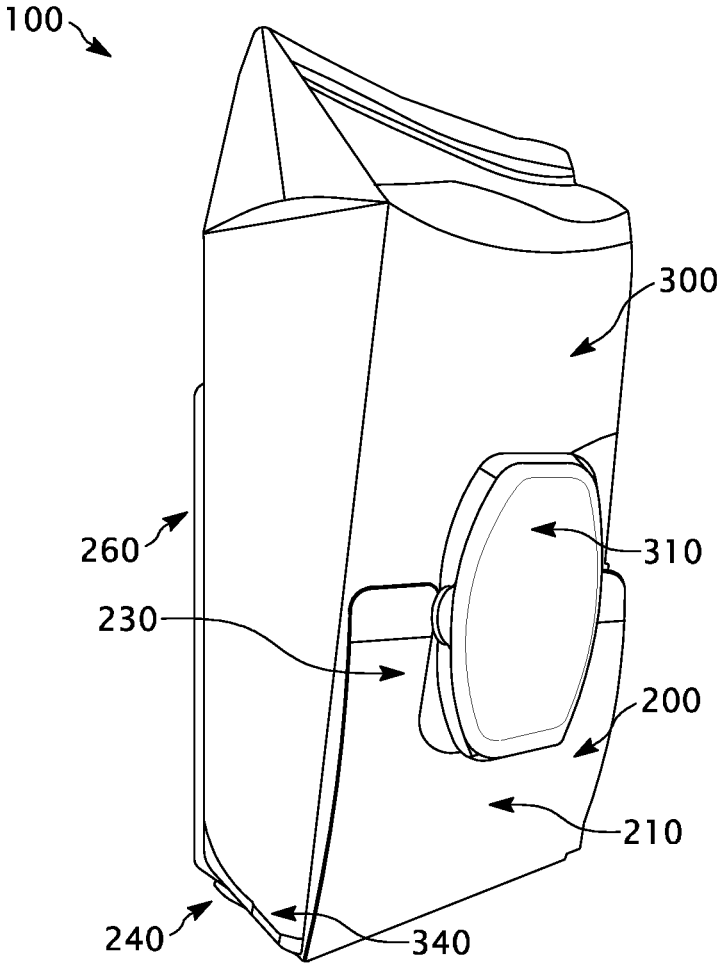
FIG. 1 is perspective view of the wipes container package supported by a base of the wipes container holder, according to the disclosed subject matter.

Solely for purpose of illustration, an exemplary embodiment of a wipes container package, is shown schematically in FIG. 1. The examples herein are not intended to limit the scope of the disclosed subject matter in any manner. Particularly, and as illustrated, FIG. 1 is a perspective view of the wipes container package 100. The wipes container package 100 includes a wipes container holder 200 and a flexible wipes container 300.

Figure 2:
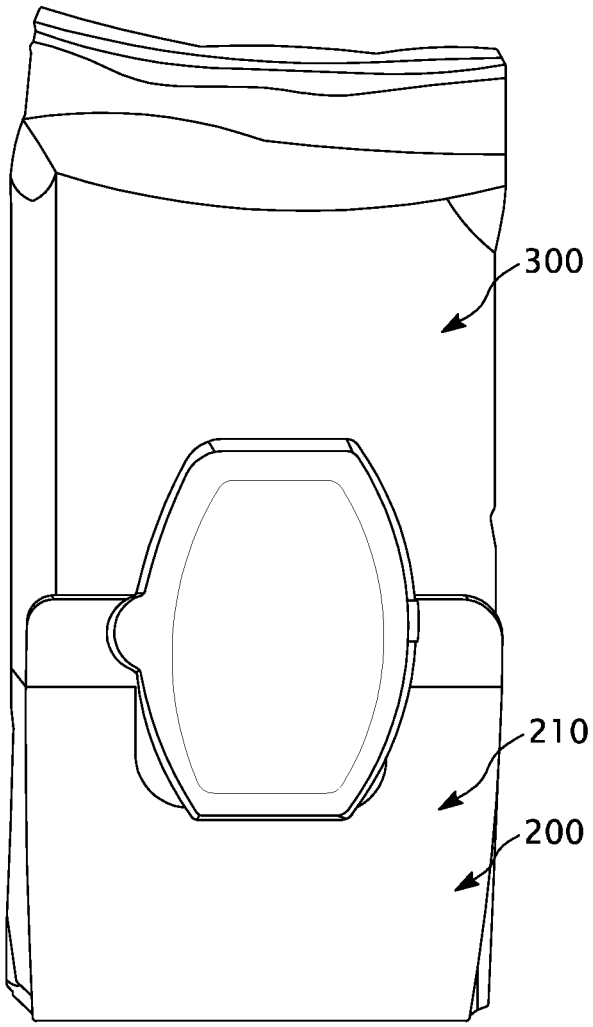
FIG. 2 is a front view of the wipes container package of FIG. 1.
Figure 3:
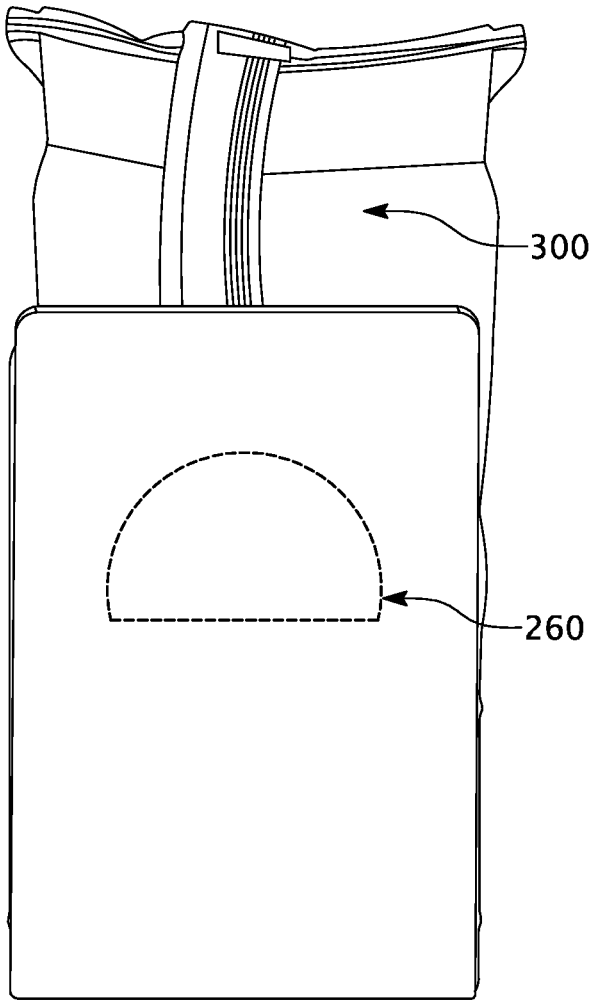
FIG. 3 is a back view of the wipes container package of FIG. 1.
Figure 4:
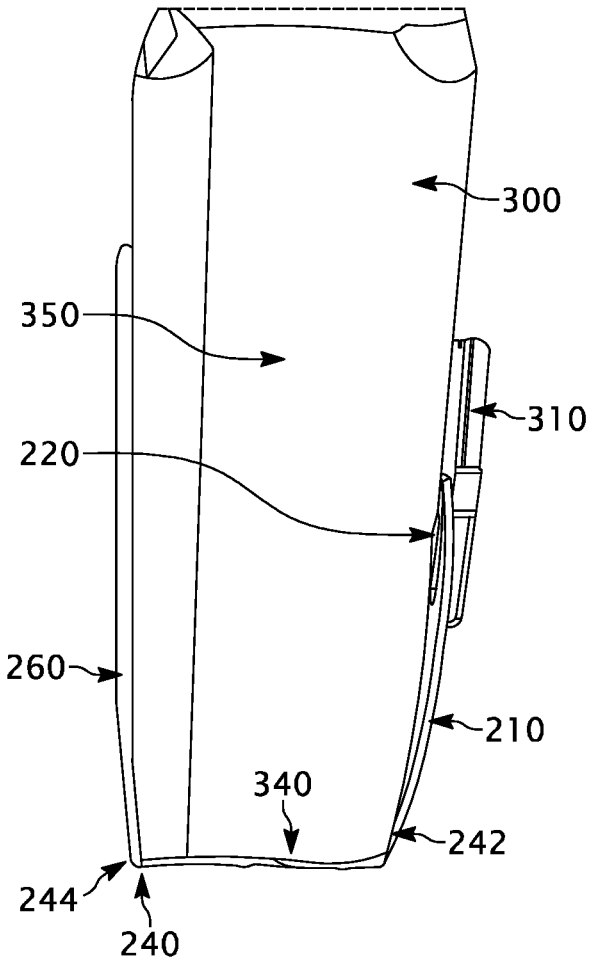
FIG. 4 is a left side view of the wipes container package of FIG. 1.

FIG. 2 is a front view of the wipes container package of FIG. 1 and FIG. 3 is a back view of the wipes container package of FIG. 1. FIG. 4 is a left side view of the wipes container package with the right side view being substantially the same. As best shown in FIGS. 1 and 4, the wipes container holder 200 has a front panel 210, a base 240, and a back panel 260. The base 240 supports a side 340 of a flexible wipes container as shown in FIG. 1. The front panel 210 extends from a first side 242 of the base and the back panel 260 extends from the second side 244 of the base. The front panel 210 further defines a slot 230, as further discussed herein.

Figure 5:
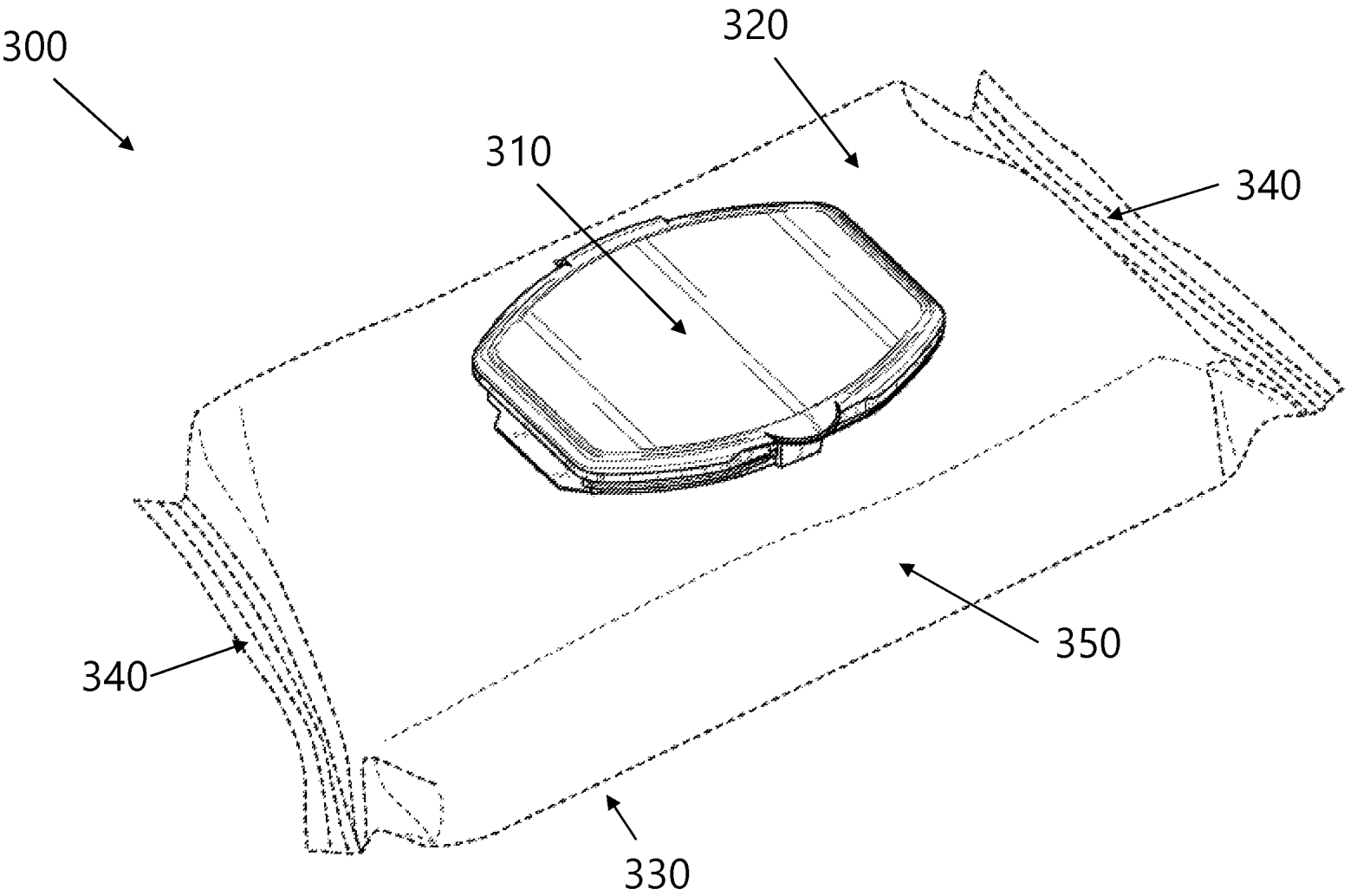
FIG. 5 is a flexible wipes container according to the disclosed subject matter.

FIG. 5 is a perspective view of a flexible wipes container 300 with a lid 310 that is couplable with the wipes container holder 200. The flexible wipes container has a top surface 320, bottom surface 330, and transverse and longitudinal sides 340, 350. The flexible wipes container can contain any suitable articles, such as but not limited to nonwovens, wet wipes, dry wipes, moist toilet tissue, facial wipes, baby wipes, and the like. The flexible wipes container can include any suitable material such as but not limited to a relatively flexible resin material, coated papers, calcium carbonate papers or other synthetic paper including various thermoforming packaging solutions. The lid of the container can include any suitable material such as but not limited to plastic, silicone, rubber, wood-based materials, metallic materials, and any flexible or semi-rigid resalable labels.

As shown throughout the figures and as best shown in FIG. 1, the base 240 of the wipes container holder supports the side 340 of the flexible wipes container and the lid 310 of the flexible wipes container is received within the slot 230 of the front panel. The exterior surface of the front panel is shown in FIG. 1 with an interior surface of the front panel interfacing with the top surface of the flexible wipes container 300. The front and back panels of the wipes container holder cooperate together to couple the wipes container holder 200 to the flexible wipes container 300.

Figure 6:
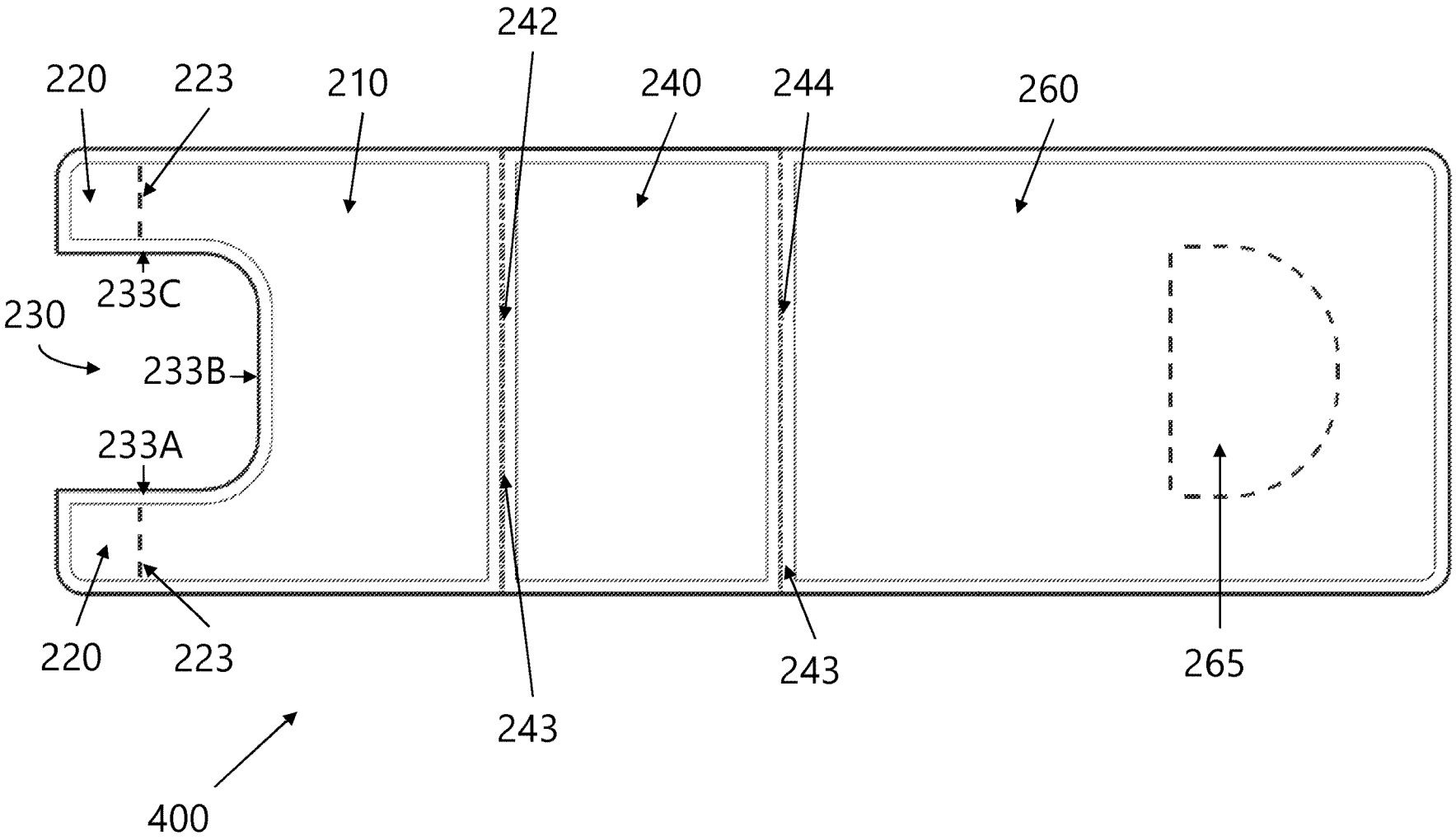
FIG. 6 is a plan view of a blank for a wipes container holder, according to the disclosed subject matter.

FIG. 6 is a unitary blank 400 that forms the wipes container holder and includes the front panel 210, base 240, and back panel 260. The base is defined by fold lines 243 of the blank, which define the first side 242 of the base and the second side 244 of the base. The front panel 210 defines a slot 230 to receive a lid of a flexible wipes container. The slot can be defined by three edges of the front panel 233A, 233B, and 233C. The slot of the front panel enables a user to open the lid of the flexible wipes container while the wipes container holder is affixed to the flexible wipes container and while supported by the base.

Figure 7:
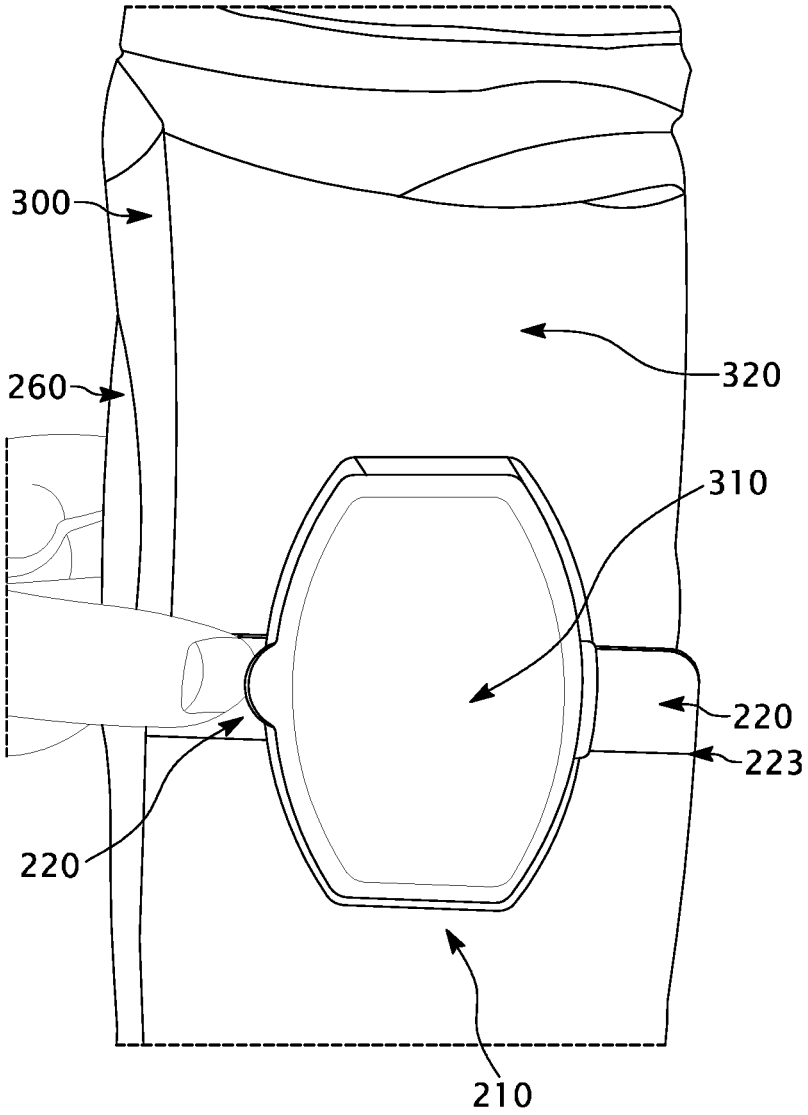
FIG. 7 is front view of the wipes container package of FIG. 1 that is grippable about the front and back panels.
Figure 8:
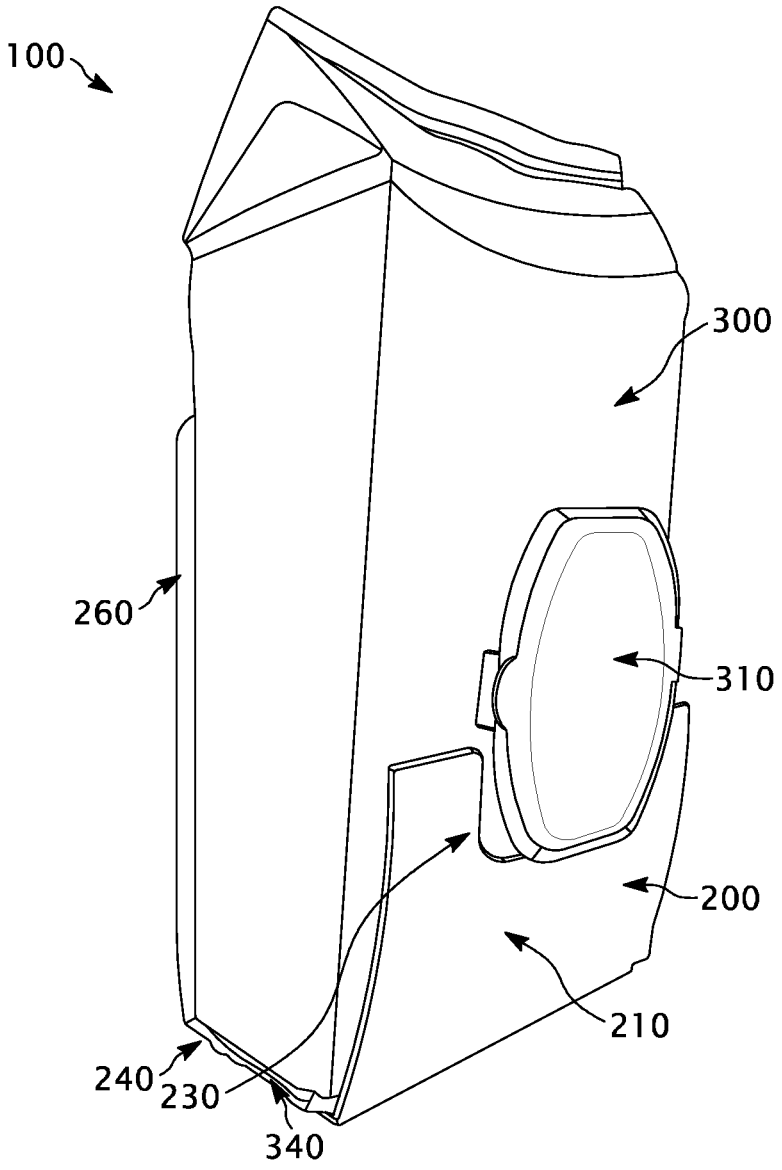
FIG. 8 is perspective view of the wipes container package supported by a base of the wipes container holder according to an embodiment of the disclosed subject matter.
Figure 9:
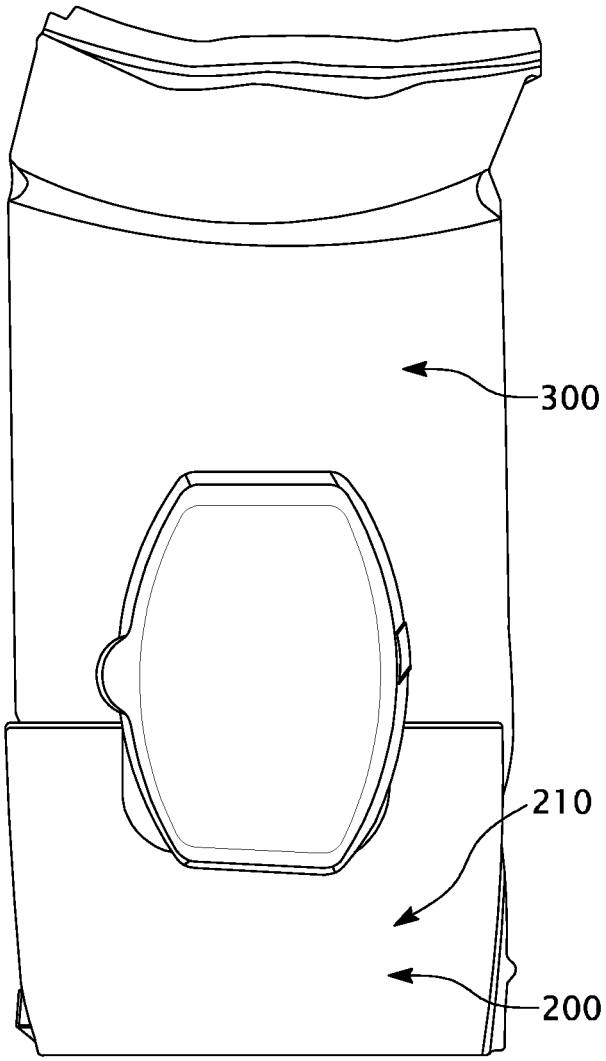
FIG. 9 is a front view of the wipes container package of FIG. 8.

As best shown in FIG. 6, the front panel 210 can further include either tab perforation lines or tab fold lines 223 opposite the first side 242 of the base to define tabs 220. When embodied as tab perforation lines as shown in the embodiment of FIGS. 1-5, the tabs 220 function as an extension of the front panel 210 and are contiguous with the front panel 210. The tabs have an inner surface and an outer surface. The inner surface of the tabs can include an adhesive along the inner surface thereof to couple the front panel with the top surface of the flexible wipes container. The tabs can indicate a desired location for the wipes container holder to be gripped along its outer surface, as depicted in FIG. 7. The tab perforated lines 223 can furthermore permit the tabs 220 to be separated from the front panel along the perforated lines 223. As such, the perforations can permit a remainder of the wipes container holder external to the tabs be removable from the flexible wipes container along the perforations, such that only the tabs 220 remain on the top surface 320 of the wipes container. In such configuration, the tabs can still function as a grip location to assist in opening the lid while pushing down on the tabs.

Figure 10:
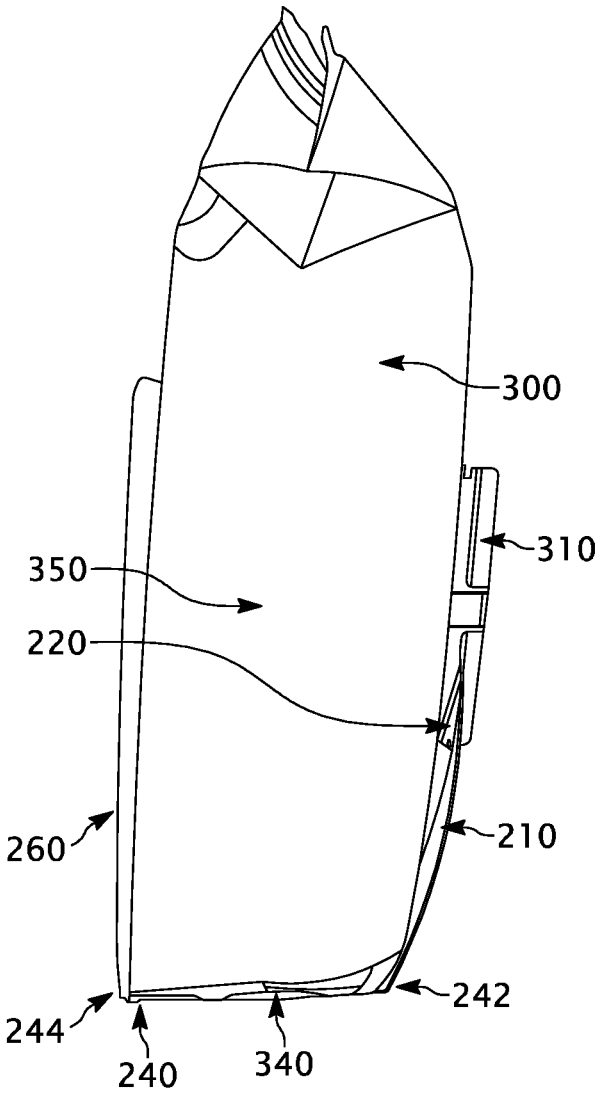
FIG. 10 is a left side view of the wipes container package of FIG. 8.
Figure 11:
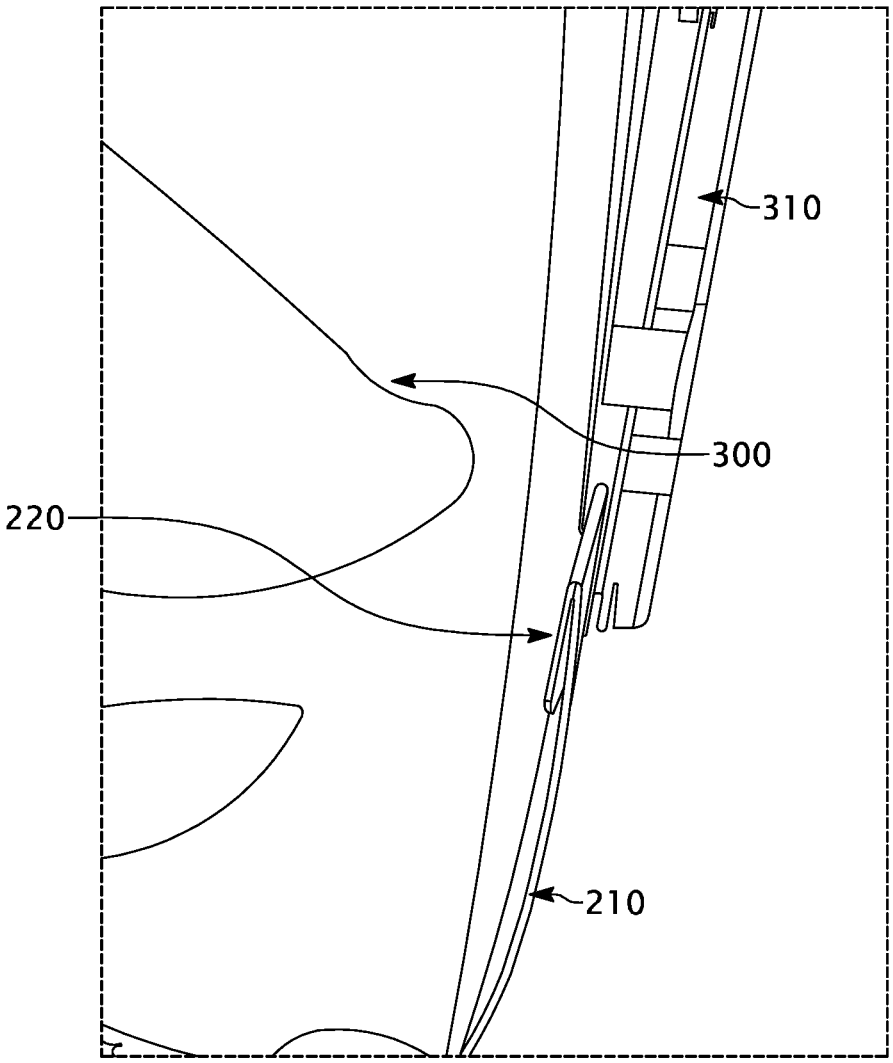
FIG. 11 is a side perspective maximized view of the front panel of the wipes container package of FIG. 8.

FIGS. 8-11 depicts an alternative embodiment with the wipes container holder having tab fold lines 223. In this embodiment, the outer surface of each tab is contiguous with the exterior surface of the front panel, but the tab itself folds back. In such embodiment, when the blank is assembled into the wipes container holder, the tabs can be folded such that the inner surface of the tab interfaces with the interior surface of the front panel, as best shown in FIGS. 10 and 11. When the blank is assembled into the wipes container holder, the tabs can include an adhesive along the outer surface thereof to couple the front panel with the top surface of the flexible wipes container. The structure of having the tabs being folded and then adhered to the top surface of the flexible wipes container can create additional tension to keep the flexible wipes container upright on its transverse side. In either embodiment having tab perforation lines or tab fold lines, the adhesive can be any suitable material, such as but not limited to glue, tape, and the like and be a temporary or a permanent adhesive.

Figure 12:
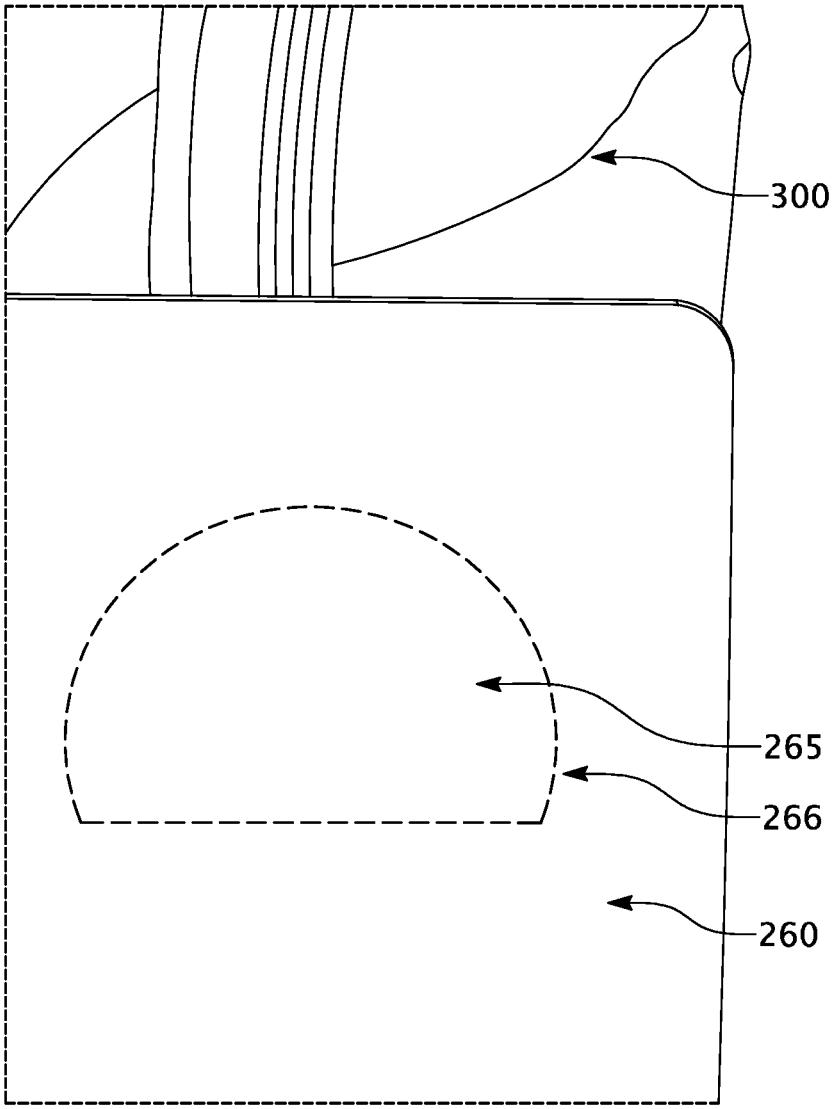
FIG. 12 is a maximized view of the perforated segment of the back panel of the wipes container package of FIG. 1.

In some embodiments, the back panel includes a perforated segment 265, as shown in FIG. 12. The perforated segment can be of any suitable shape. As depicted, the perforated segment is in a half circle configuration. When the blank is assembled into the wipes container holder, the perforated segment includes adhesive on an interior surface thereof to couple the back panel with a bottom surface of the flexible wipes container. FIG. 12 depicts the perforated segment 265 of the back panel as coupled with the flexible wipes container 300.

Figure 13:
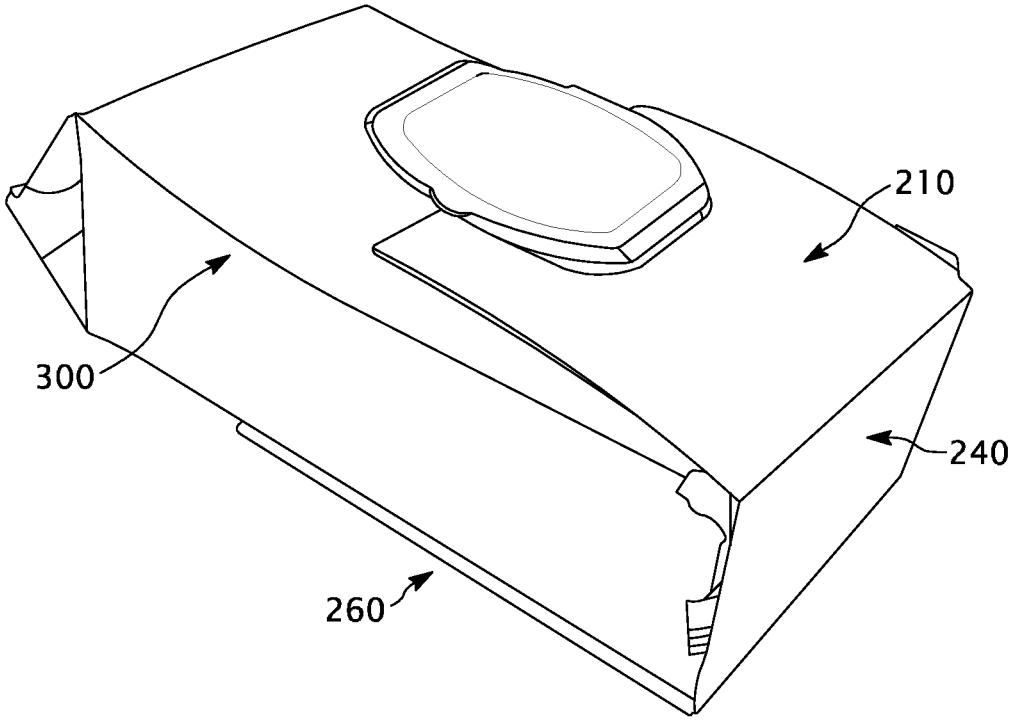
FIG. 13 is a side perspective view of the wipes container package of FIG. 1.

The perforated segment 265 can be permanently or temporarily attached to the bottom surface of the wipes container. The perforations 266 can permit a remainder of the wipes container holder external to the perforated segment be removable from the flexible wipes container along the perforations, such that only the segment 265 remains on the bottom surface 330. It is noted that although the segment 255 is depicted with perforations 266, any suitable scoring is contemplated herein, such as but not limited to microperf, scoring lines, kiss cuts, die cuts, or the like. When the wipes package is resting on its bottom surface on a ledge such as the back shelf of a toilet, the perforated segment 265 (with or without the remainder of the wipes container holder) can provide a friction surface to reduce slippage of the wipes container package for any ledges positioned on an incline. Accordingly, the back panel or alternatively just the segment 265 can further include a coating, such as a textured coating to facilitate the friction surface. Furthermore, the back panel or alternatively just the segment 265 can include a removable label to tape to expose a tacky substance to further provide securement for the wipes package. In such manner, the wipes package may be able to adhere to vertical surfaces such as a wall. Such securement features can further facilitate one-hand opening and operation of the wipes package. FIG. 13 depicts the wipes container package resting on the back panel.

The front and back panel of the wipes container holder cooperate together to couple the wipes container holder to the flexible wipes container. In particular, the adhesive on the back panel and the adhesive on the tabs facilitate a secure connection between the flexible wipes container and the wipes container holder.

As best shown in FIG. 1 and FIG. 4, the wipes container holder can interface with at least three surfaces of the flexible wipes container such as along the bottom surface, the side, and the top surface of the flexible wipes container. As shown, the front and back longitudinal surfaces of the flexible wipes container are uncovered by the wipes container holder, which reduces waste and promotes cost efficiency for the holder.

Figure 14:
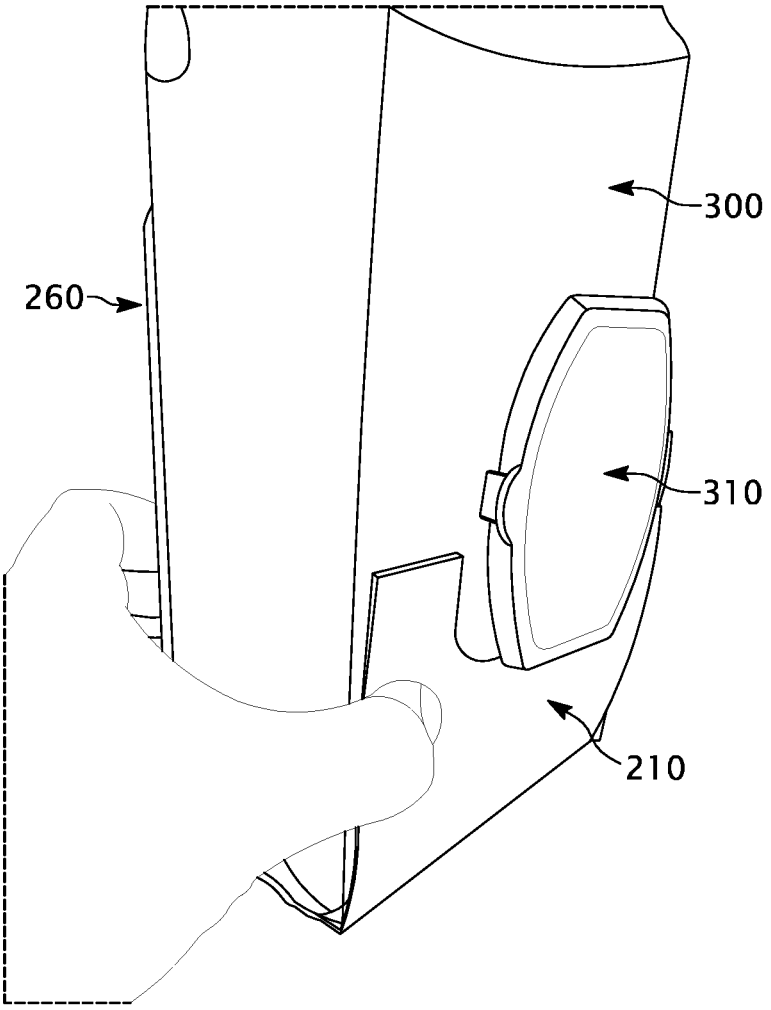
FIG. 14 is perspective view of the wipes container package of FIG. 8 that is grippable about the front and back panels.

During use of the wipes container package, a user can grip the wipes container holder at the front and back panels with one hand. FIGS. 7 and 14 depict the wipes container packages of FIGS. 1 and 8 respectively being grippable about the wipes container holder along the front panel and back panel. Such configuration can further dampen noise of the flexible wipes container when the wipes container package is gripped. Since the flexible wipes container can be made of a thin film, such film can be noisy when handled, which is not ideal for baby wipes containers when changing a sleeping baby. The wipes container holder can dampen such noise during the opening and/or closing of the lid 310, or during general movement of the wipes container package.

A plurality of suitable materials can be used for the blank of the disclosed subject matter, such as, but not limited to paper materials such as paperboard, corrugated board, synthetic paperboard, printed PET material and the like. The container holder formed by the blank of the disclosed subject matter can be any suitable size, shape, and dimension, such as suitable to contain a flexible wipes container of varying sizes. The embodiments of the disclosed subject matter depict a rectangular shaped flexible wipes container, but other shapes such as, square, and the like are further contemplated. Furthermore, the blank can include a plurality of dimensions and can accommodate a plurality of different volumes of products.

While the disclosed subject matter is described herein in terms of certain preferred embodiments, those skilled in the art will recognize that various modifications and improvements can be made to the disclosed subject matter without departing from the scope thereof. Additional features known in the art likewise can be incorporated, such as disclosed in U.S. Pat. Nos. 8,939,320; 9,826,736; 9,230,388; and 7,665,629 and U.S. Publication No. 2017/0202409, each of which is incorporated by reference in its entirety herein. Moreover, although individual features of one embodiment of the disclosed subject matter can be discussed herein or shown in the drawings of the one embodiment and not in other embodiments, it should be apparent that individual features of one embodiment can be combined with one or more features of another embodiment or features from a plurality of embodiments.

In addition to the various embodiments depicted and claimed, the disclosed subject matter is also directed to other embodiments having any other possible combination of the features disclosed and claimed herein. As such, the particular features presented herein can be combined with each other in other manners within the scope of the disclosed subject matter such that the disclosed subject matter includes any suitable combination of the features disclosed herein. Furthermore, although reference is made to a flexible wipes container throughout this disclosure, other suitable containers can benefit from the blank described herein such as flexible containers for other goods, such as food products. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the disclosed subject matter without departing from the spirit or scope of the disclosed subject matter. Thus, it is intended that the disclosed subject matter include modifications and variations that are within the scope of the appended claims and their equivalents.

What is claimed is:

1. A unitary blank for forming a wipes container holder, comprising:

a base defined by fold lines of the unitary blank and configured to support a side of a flexible wipes container, the fold lines defining a first side of the base and a second side of the base;

a front panel extending from the first side of the base, wherein the front panel defines a slot configured to receive a lid of the flexible wipes container; and a back panel extending from the second side of the base, wherein the front panel and the back panel cooperate together to form the wipes container holder configured to couple with the flexible wipes container, wherein the back panel includes a perforated segment, wherein the perforated segment includes adhesive configured to couple the back panel with a bottom surface of the flexible wipes container.

2. The unitary blank of claim 1, wherein the front panel includes tab lines opposite the first side to define tabs, wherein the tabs are configured to couple the front panel with a top surface of the flexible wipes container.

3. The unitary blank of claim 2, wherein the back panel and the tabs are configured to cooperate together to couple the unitary blank to a bottom and top surface of the flexible wipes container respectively.

4. A wipes container holder comprising the unitary blank of claim 1.

5. A wipes container package, comprising the unitary blank of claim 1; and a flexible wipes container having a side and a top surface with a lid, wherein the base of the unitary blank supports the side of the flexible wipes container and the lid of the flexible wipes container is received within the slot of the front panel.

6. The wipes container package of claim 5, wherein the front panel of the unitary blank includes tab lines opposite the first side of the base to define tabs, wherein the tabs include an adhesive configured to couple the front panel with the top surface of the flexible wipes container.

7. The wipes container package of claim 1, wherein the perforated segment is permanently attached to the bottom surface of the wipes container and a remainder of the unitary blank external to the perforated segment is removable from the flexible wipes container.

8. The unitary blank of claim 1, wherein the perforated segment comprises at least one of microperfs, scoring lines, kiss cuts, or die cuts.

9. The unitary blank of claim 1, wherein the perforated segment comprises a friction surface configured to reduce slippage of the flexible wipes container.

10. A wipes container holder comprising:

a base configured to support a side of a flexible wipes container, the base having a first side and a second side;

a front panel extending from the first side of the base, wherein the front panel defines a slot configured to receive a lid of the flexible wipes container; and a back panel extending from the second side of the base, wherein the front panel and the back panel cooperate together to couple the wipes container holder to the flexible wipes container, wherein the back panel includes a perforated segment, wherein the perforated segment includes adhesive configured to couple the back panel with a bottom surface of the flexible wipes container.

11. The wipes container holder of claim 10, wherein the front panel includes tab lines opposite the first side to define tabs, wherein the tabs couple the front panel with a top surface of the flexible wipes container.

12. The wipes container holder of claim 10, wherein the wipes container holder interfaces with a bottom surface, a side, and a top surface of the flexible wipes container, wherein a front and back surface of the flexible wipes container are uncovered by the wipes container holder.

13. A wipes container package, comprising:

a wipes container holder and a flexible wipes container;

the wipes container having a base to support a side of the flexible wipes container, the base having a first side and a second side, a front panel extending from the first side of the base, wherein the front panel defines a slot configured to receive a lid of the flexible wipes container, and a back panel extending from the second side of the base; and the flexible wipes container having a side and a top surface with a lid, wherein the base of the wipes container holder supports the side of the flexible wipes container and the lid of the flexible wipes container is received within the slot of the front panel, wherein the front panel and the back panel of the wipes container holder cooperate together to couple the wipes container holder to the flexible wipes container, wherein the front panel of the wipes container holder includes tab lines opposite the first side of the base to define tabs, wherein the tabs include an adhesive configured to couple the front panel with the top surface of the flexible wipes container, and wherein the back panel includes a perforated segment, wherein the perforated segment includes adhesive configured to couple the back panel with a bottom surface of the flexible wipes container.

14. The wipes container package of claim 13, wherein the perforated segment is permanently attached to the bottom surface of the wipes container and a remainder of the wipes container holder external to the perforated segment is removable from the flexible wipes container.

15. The wipes container package of claim 14, wherein the perforated segment provides a friction surface to reduce slippage of the wipes container package positioned on an incline.

16. The wipes container package of claim 13, wherein the wipes container package is grippable about the wipes container holder.

17. The wipes container package of claim 16, wherein the wipes container holder dampens noise of the flexible wipes container when the wipes container package is gripped.

18. The wipes container package of claim 13, wherein the wipes container holder interfaces with a bottom surface, the side, and the top surface of the flexible wipes container, wherein a front and back surface of the flexible wipes container are uncovered by the wipes container holder.

19. A wipes container package, comprising:

a wipes container holder and a flexible wipes container;

the wipes container having a base to support a side of the flexible wipes container, the base having a first side and a second side, a front panel extending from the first side of the base, wherein the front panel defines a slot configured to receive a lid of the flexible wipes container, wherein the front panel of the wipes container holder includes tab lines opposite the first side of the base to define tabs, and a back panel extending from the second side of the base; and the flexible wipes container having a top surface with a lid, wherein the base of the wipes container holder supports the side of the flexible wipes container, and the lid of the flexible wipes container is received within the slot of the front panel, wherein the front panel and the back panel of the wipes container holder cooperate together to couple the wipes container holder to the flexible wipes container, and wherein the tabs have an inner surface and an outer surface, the tabs being folded to interface the inner surface of the tab with an interior surface of the front panel, wherein the outer surface of the tab includes the adhesive configured to couple the front panel with the top surface of the flexible wipes container.

20. The wipes container package of claim 19, wherein the tabs include tab perforation lines configured to the allow the tabs to be permit the tabs to be separated from the front panel.

* * * * *